United States Patent [19]

Marino

[11] Patent Number: 5,073,967

[45] Date of Patent: Dec. 17, 1991

[54] HUMIDIFIER DEVICE WITH DELAYED ENERGIZATION

[75] Inventor: Frank Marino, Upton, Mass.

[73] Assignee: Duracraft Corporation, Sudbury, Mass.

[21] Appl. No.: 726,678

[22] Filed: Jul. 8, 1991

[51] Int. Cl.[5] ..... F22B 1/28

[52] U.S. Cl. ..... 392/406; 392/403; 392/394

[58] Field of Search ..... 392/406, 394, 402, 403, 392/404, 405

[56] References Cited

U.S. PATENT DOCUMENTS

| | | | |
|---|---|---|---|
| 1,756,053 | 4/1930 | Colton | 392/402 |
| 1,791,313 | 2/1931 | Hillpot | 392/402 |
| 3,209,125 | 9/1965 | Morrissey | 392/402 |
| 3,664,324 | 5/1972 | Radtke | 392/402 |
| 4,139,762 | 2/1979 | Pohrer | 392/402 |
| 4,612,434 | 9/1986 | Ianitelli | 392/405 |

*Primary Examiner*—Teresa J. Walberg

*Attorney, Agent, or Firm*—John E. Toupal; Harold G. Jarcho

[57] ABSTRACT

A humidifier including a base defining a liquid reservoir; an electrically energized humidification device adapted to induce dispersion of liquid retained by the reservoir; a power supply for supplying electrical current to the humidification device; a control circuit connecting the power supply to the humidification device and including a switch operable in an active state to produce energizing current flow between the power supply and the humidification device and operable in an inactive state to prevent energizing current flow therebetween; and a sensing mechanism operatively coupled to the switch and adapted to sense the liquid level in the reservoir, the sensing mechanism adapted to provide the active state for the switch in response to a minimum liquid level in the reservoir and to provide the inactive state for the switch in response to a liquid level in the less than the minimum liquid level. Also included is a delay for delaying the energizing current flow between the power supply and the humidification device for a given period after the level of liquid in the reservoir reaches the minimum liquid level. The provision of a delay prevents the premature flow of current to the humidification device.

15 Claims, 3 Drawing Sheets

HUMIDIFIER DEVICE WITH DELAYED ENERGIZATION

BACKGROUND OF THE INVENTION

This invention relates generally to a humidifier device, and more particularly, to an electrical humidifier device in which energization is delayed to ensure that a liquid reservoir cavity is fully filled.

Humidifier devices typically include a reservoir cavity and a humidification unit such as a heater coil, an ultrasonic transducer or an impeller that can be energized to induce dispersion of liquid retained by a reservoir cavity. Most humidification units can be damaged if energized without a sufficient level of water in the reservoir cavity. For example, a heating element can burn out if heated while dry and then quenched in water, an ultrasonic transducer can be burned out if it oscillates without being covered by a sufficient height of liquid or an impeller modem can undesirably rotate at a potentially harmful excessive rpm with operating without a sufficient water load. Consequently, most humidifier devices employ a liquid level sensor that will deenergize the humidification unit when the level of liquid in the reservoir cavity falls below a given minimum level.

However, typical liquid level sensing devices such as float operated switches exhibit a form of backlash that inherently responds to a slightly lower liquid level during reservoir cavity filling than to a falling level of reservoir cavity liquid level. That is, a typical sensing switch will be closed during reservoir filling operations at a level slightly lower than the reducing liquid level required to induce switch deactivation. Since typical sensing devices exhibit some level of operating tolerance, they are generally designed, therefore, to produce switch activation at a liquid level somewhat below the desired reservoir liquid operating level. Consequently, the switches in conventional devices can be activated to energize and thereby possibly damage the humidification unit before the reservoir cavity has been adequately filled, and possibly damaged. This problem is exacerbated in those devices employing a liquid supply tank that feeds water to the liquid cavity at a relatively slow rate.

The object of this invention, therefore, is to provide an improved humidifier device that ensures adequate filling of a reservoir cavity before energization of a humidification unit.

SUMMARY OF THE INVENTION

The invention is a humidifier including a base defining a liquid reservoir; an electrically energized humidification means adapted to induce dispersion of liquid retained by the reservoir; a power supply for supplying electrical current to the humidification means; a control circuit connecting the power supply to the humidification means and including a switch operable in an active state to produce energizing current flow between the power supply and the humidification means and operable in an inactive state to prevent energizing current flow therebetween; and a sensing mechanism operatively coupled to the switch and adapted to sense the liquid level in the reservoir, the sensing mechanism adapted to provide the active state for the switch in response to a minimum liquid level in the reservoir and to provide the inactive state for the switch in response to a liquid level less than the minimum liquid level. Also included is a delay means for delaying the energizing current flow between the power supply and the humidification means for a given period after the level of liquid in the reservoir reaches the minimum liquid level. The provision of a delay prevents the premature flow of current to the humidification means.

According to one feature, the humidifier also includes a liquid supply tank supported by the base and adapted to supply liquid to the reservoir. The advantages of the delay means are particularly applicable to a humidifier employing a liquid supply tank.

In an electrical version of the invention, the delay means comprises a delay circuit for delaying the energizing current flow between the power supply and the humidification means for the given period after sensing of the minimum liquid level by the sensing means. The delay circuit establishes the desired delay period.

In a hydraulic version of the invention, the base further defines a sensing chamber and a flow passage including the delay means and providing liquid communication between the supply tank and both the reservoir and the sensing chamber so as to establish proportioned liquid levels therein, and the sensing mechanism is adapted to sense the liquid level in the sensing chamber. The separate sensing chamber establishes the desired delay period.

According to one embodiment of the hydraulic version, the flow passage is arranged to provide between the tank and the sensing chamber liquid flow through the reservoir. This arrangement provides the delay period by insuring filling of the reservoir before the sensing chamber.

According to another embodiment of the hydraulic version, the delay comprises a restricted portion of the flow passage disposed between the tank and the sensing chamber. The restricted portion is adapted to establish between the tank and the sensing chamber a reduced liquid flow rate with respect to the liquid flow rate provided between the tank and the reservoir.

According to another feature of the invention, the sensing mechanism includes a float sensor responding to the liquid level in the electrical version and responding to the liquid level in the sensing chamber in the hydraulic versions. The use of the float simplifies the provision of the desired delay period.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
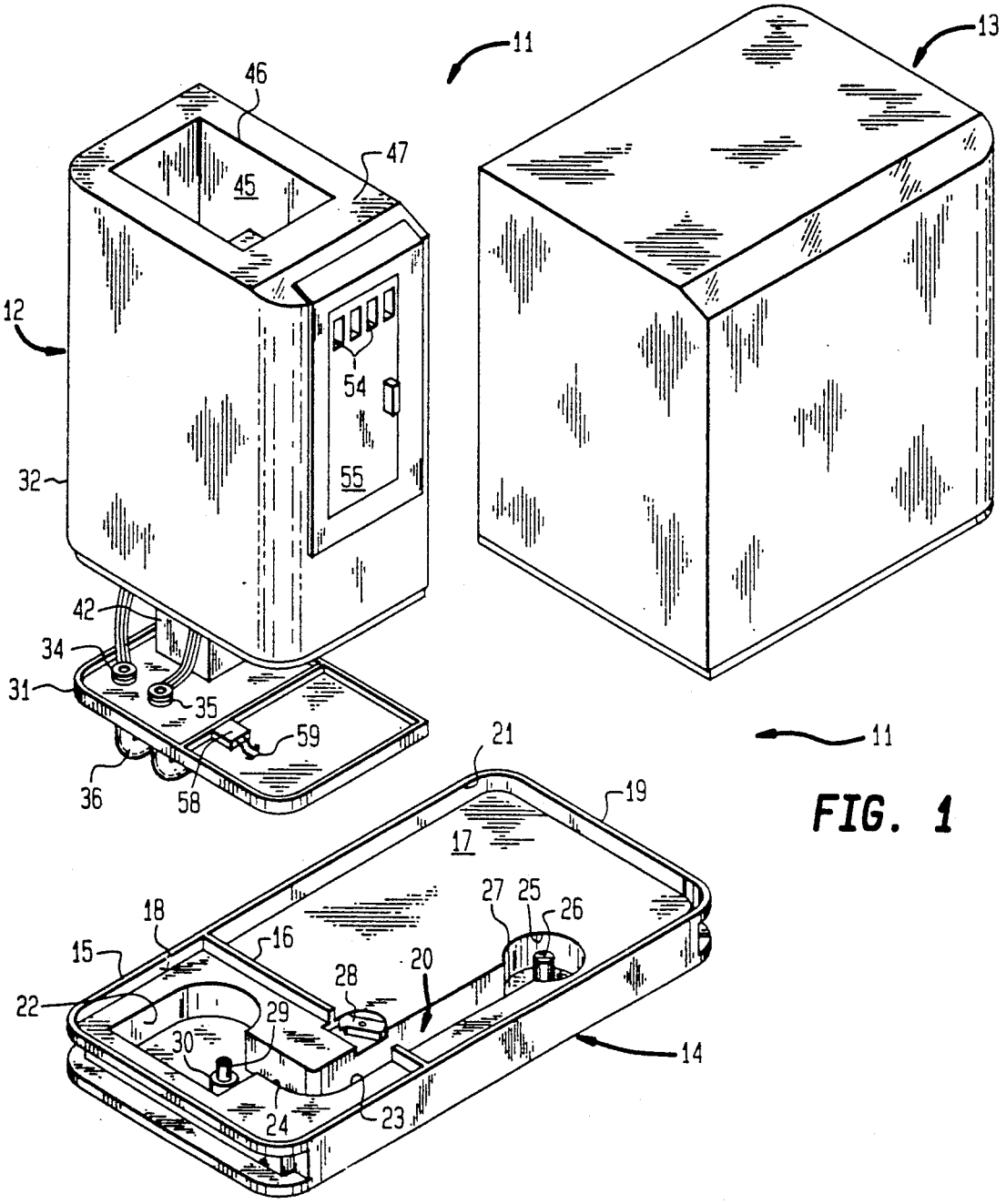
FIG. 1 is a perspective of a humidifier device according to the invention.

A humidifier 11 includes an evaporation unit 12 and a liquid supply tank 13 each removably mounted side by side on a base 14. A peripheral rim portion 15 and a divider wall 16 project upwardly from an upper surface 17 of the base 14 and define an evaporator enclosure 18 for removably receiving the evaporation unit 12. Similarly a peripheral portion 19 projecting upwardly from the upper surface 17 and the divider wall 16 define a tank enclosure 21 for removably receiving the supply tank 13.

Formed in the base 14 and below the base surface 17 is a reservoir 20 that includes a boiler cavity 22 disposed within the enclosure 18. Also included in the reservoir 20 is a liquid supply channel 23 having an outlet end 24 communicating with the boiler cavity 22 and an inlet end 25 located within the tank enclosure 21. A valve actuator stem 26 projects upwardly from a bottom 27 of the liquid supply channel 23 into the inlet end 25. Pivotally mounted on the base surface 17 is a latch member 28 for securing the unit 12 to the base 14. A liquid level sensing, buoyant actuator float member 29 is slidably retained in the cavity 22 by a slotted hollow cylindrical retainer 30.

Figure 2:
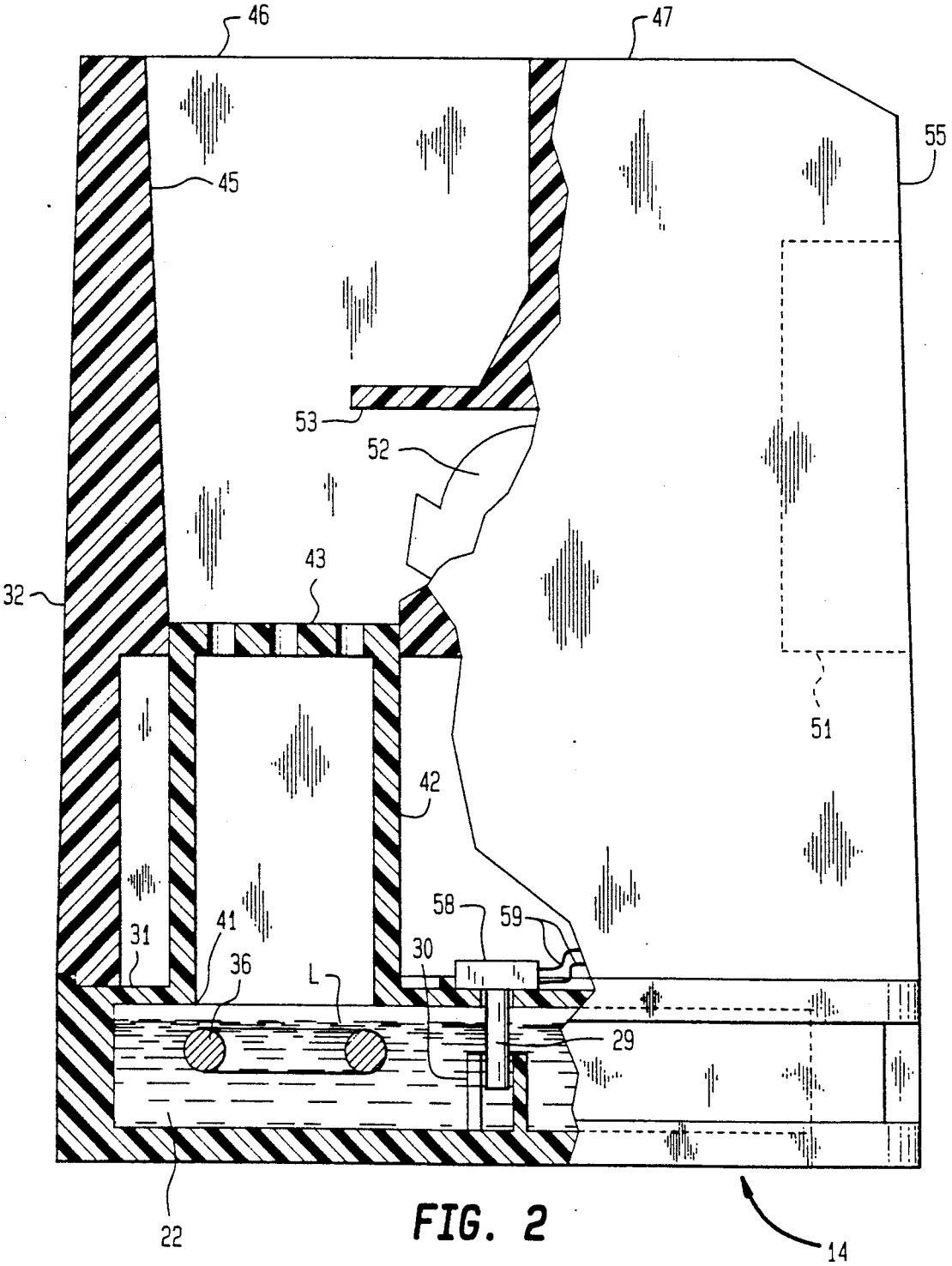
FIG. 2 is a cross sectional view of the humidifier device shown in FIG. 1.

The evaporation unit 12 includes, as shown in FIG. 2, a bottom plate 31 and an enclosure 32 supported thereby. Supported by electrical terminals 34, 35 on the bottom plate 31 and extending downwardly therefrom is a humidification inducing heater coil 36 that projects into the boiler cavity 22 in the base 14. Extending upwardly from the bottom plate 31 over an opening 41 communicating with the cavity 22 is a rectangular tube 42. A slotted cover 43 closes the upper end of the tube 42. The slotted cover 43 provides fluid communication between the tube 42 and a duct portion 45 defined by the housing 32. Established by the tube 42, the slotted cover 43 and the duct portion 45 is a vapor passage with an inlet communicating via the opening 41 with the cavity 22 and an outlet communicating with the surrounding environment via a discharge opening 46 in a top wall 47 of the housing 32. Retained by the housing 32 adjacent to the vapor passage duct portion 45 is electrical control circuitry 51 shown in FIG. 3. Also retained by the housing 32 is an air blower 52 with an outlet disposed to discharge air into the duct portion 45 through an air passage exit opening 53 therein. Air is supplied to the blower 52 through air passage entrance openings 54 in a front wall portion 55 of the housing 32. An on-off control switch 57 for actuating the electrical control circuit 51 is mounted on the front wall portion 55 of the housing 32. Also supported by the bottom plate 31 is a conventional electrical switch 58 connected by wires 59 to the circuitry 51. The switch is actuated by the float member 29 as described hereinafter.

The liquid supply tank 13 includes a bottom wall portion 62 retained within the tank enclosure 21 of the base 14 and an upper portion 63 for storing a supply of liquid such as water. Disposed in the bottom of the bottom wall portion 62 of the tank 13 is a conventional discharge check valve (not shown) having an actuator rod adapted to engage the stem 26 on the base 14. Engagement between the rod and stem 26 opens the valve producing controlled discharge of liquid from the sealed tank 13 into the inlet end 25. Such liquid release mechanisms are well known in the art.

Figure 3:
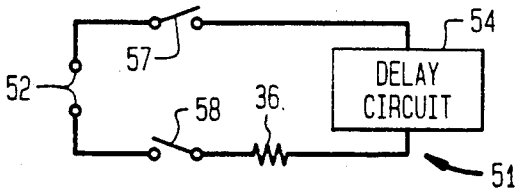
FIG. 3 is a schematic circuit diagram of a control circuit used with the device of FIGS. 1 and 2.

As shown in FIG. 3, the control circuitry 51 connects a suitable power supply 52 to the humidification inducing heater coil 53. The power supply 52 typically can consist of a plug (not shown) adapted for insertion into a conventional household outlet. Connected in series between the power supply 52 and the heater coil 53 is the float actuated switch 58, the on-off switch 57 and an electrical delay circuit 54.

OPERATION

During use of the humidifier unit 11, the manual switch 57 is closed and the supply tank 11 first is filled with water and then positioned on the base 14. That results in a flow of water through the channel 23 into the reservoir cavity 22. When the liquid in the reservoir cavity 22 reaches a given level L (FIG. 2) above the coil 36, the responsive float member 29 engages and activates the switch 58 into an active, closed state completing a circuit between the supply 52 and the heater coil 53. However, energizing current flow between the supply 52 and the coil 53 is delayed by the electrical delay circuit 54. Therefore, a complete filling of the reservoir cavity 22 is ensured before energization of the heater coil 53 which is thereby protected from damage. Upon energization of the heater coil 36, water within the reservoir cavity 22 is heated to cause evaporation. The vapor produced rises through the tube 42, the slotted cover 43 and the duct portion 45 of the housing 32 for discharge through the discharge end 46 into the surrounding environment. Enhancement of the vapor discharge is obtained by the blower 52 which draws air through the entrance passages 54 in the housing 32 for discharge through the exit passage 53. This air draws vapor formed in the boiler cavity 22 through the duct portion for discharge from the discharge end 46.

Figure 4:
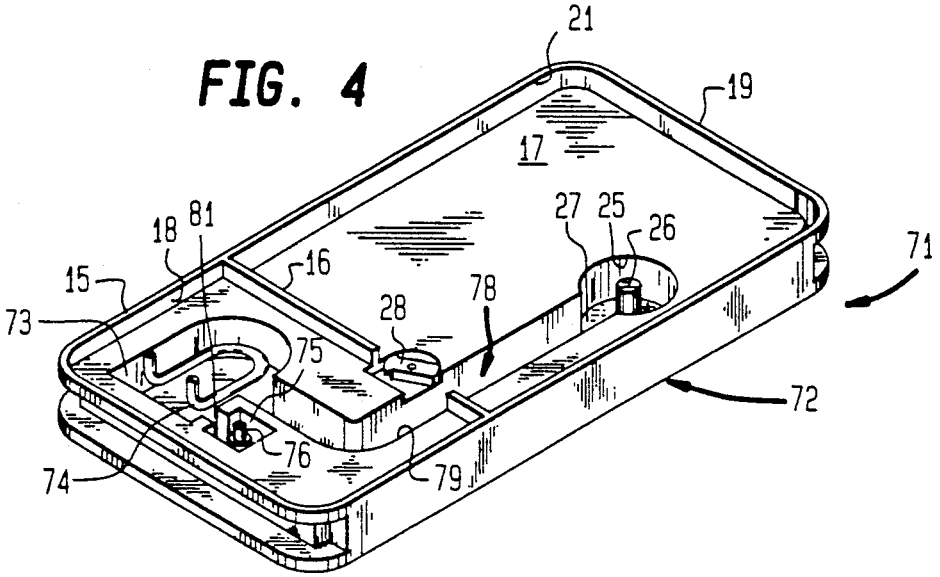
FIG. 4 is a perspective view of another humidifier device embodiment of the invention.

FIG. 4 illustrates another humidifier device embodiment 71 having a modified base 72. In addition to a reservoir 73 retaining a heater coil 74, the base 73 defines a sensing chamber 75. Retained by the sensing chamber 75 is a liquid level sensing float 76 disposed to actuate the electrical switch 58 shown in FIGS. 1–3. The base 72 defines a flow passage channel 78 that provides liquid communication between the supply tank 13 and both the reservoir 73 and the sensing chamber 75. Liquid emerging from the tank 13 flows through the inlet portion 79 of the flow passage channel 78 to the reservoir 73 and then through an auxiliary channel portion 81 to the sensing chamber 75. Because the liquid flow path provided by the passage 78, a complete filling of the reservoir 73 to a desired minimum level L above the heater coil 74 is ensured before that level is reached in the sensing chamber 75 causing the float 76 to induce actuation of the switch 58 into its active state and resultant current flow between the supply 62 and the heater coil 74.

Figure 5:
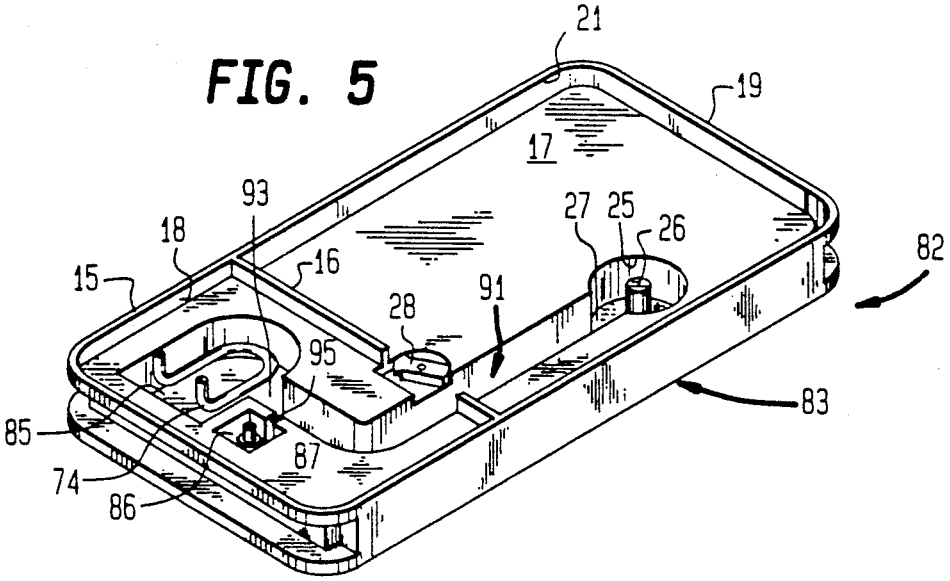
FIG. 5 is a perspective view illustrating another humidifier device embodiment of the invention.

FIG. 5 illustrates another humidifier device embodiment 82 having a modified base 83. Defined by the base 84 is a reservoir 85 retaining a heater coil 74 and a sensing chamber 86 retaining a sensing float 87. Also defined by the base 83 is a flow passage channel 91 providing liquid communication between the tank and both the sensing chamber 86 and reservoir 85. The flow passage channel 91 includes an inlet passage portion 93 communicating between the discharge from the tank 13 and the reservoir 85 and a restricted passage portion 95 providing liquid flow to the sensing chamber 86.

During use of the embodiment 82, the tank 13 is again filled and positioned on the base 83 to produce liquid flow through the inlet passage portion 93 of the channel 91 to the reservoir 85. Liquid also flows through the restricted passage portion 95 into the sensing chamber 86. However, because of the reduced flow rate allowed by the restricted passage portion 95, the reservoir 85 fills more rapidly than does the sensing chamber 86

Accordingly, complete filling of the reservoir 85 to a given minimum operating level L that fully emerges the heater coil 74 is ensured before that level is established in the sensing chamber 86 to induce activation of the switch 58 by the sensing float 87. Potentially damaging, premature energization of the heater coil 74 thereby is prevented by the delay in energization established by the restricted delay portion 95 of the flow passage channel 91.

Obviously, many modifications and variations of the present invention are possible in light of the above teachings. For example, although the invention has been described in connection with a humidifier device employing an evaporation inducing heater coil, the invention can be utilized with humidifier devices employing other humidification units such as ultrasonic transducers or impellers. It is to be understood, therefore, that the invention can be practiced otherwise than as specifically described.

What is claimed is:

1. Humidifier apparatus comprising:

base means defining a liquid reservoir;

electrically energized humidification means adapted to induce dispersion of liquid retained by said reservoir;

power supply means for supplying electrical current to said humidification means;

control circuit means connecting said power supply means to said humidification means and including switch means operable in an active state to produce energizing current flow between said power supply means and said humidification means and operable in an inactive state to prevent energizing current flow therebetween;

sensing means operatively coupled to said switch means and adapted to sense the liquid level in said reservoir, said sensing means adapted to provide said active state for said switch means in response to a minimum liquid level in said reservoir and to provide said inactive state for said switch means in response to a liquid level in said reservoir less than said minimum liquid level; and delay means for delaying said energizing current flow between said power supply means and said humidification means for a given period after the level of liquid in said reservoir reaches said minimum liquid level.

2. An apparatus according to claim 1 including a liquid supply tank supported by said base means and adapted to supply liquid to said reservoir.

3. An apparatus according to claim 2 wherein said delay means comprises a delay circuit means for delaying said energizing current flow between said power supply means and said humidification means for said given period after sensing of said minimum liquid level by said sensing means.

4. An apparatus according to claim 2 wherein said base means further defines a sensing chamber and flow passage means including said delay means and providing liquid communication between said supply tank and both said reservoir and said sensing chamber so as to establish proportioned liquid levels therein, and said sensing means is adapted to sense the liquid level in said sensing chamber.

5. An apparatus according to claim 4 wherein said flow passage means is adapted to establish equal liquid levels in said reservoir and said sensing chamber.

6. An apparatus according to claim 4 wherein said flow passage means is arranged to provide between said tank and said sensing chamber liquid flow through said reservoir.

7. An apparatus according to claim 4 wherein said delay means comprises a restricted portion of said flow passage means disposed between said tank and said sensing chamber, said restricted portion adapted to establish between said tank and said sensing chamber a reduced liquid flow rate with respect to the liquid flow rate provided between said tank and said reservoir.

8. An apparatus according to claim 1 wherein said delay means comprises a delay circuit means for delaying said energizing current flow between said power supply means and said humidification means for said given period after sensing of said minimum liquid level by said sensing means.

9. An apparatus according to claim 1 wherein said sensing means comprises a float means.

10. An apparatus according to claim 1 wherein said base means further defines a sensing chamber and flow passage means including said delay means and providing liquid communication between said reservoir and said sensing chamber, said flow passage means comprising liquid inlet means communicating with said reservoir and adapted to allow filling thereof with liquid.

11. An apparatus according to claim 10 wherein said flow passage means is adapted to establish equal liquid levels in said reservoir and said sensing chamber.

12. An apparatus according to claim 11 wherein said flow passage means is arranged to provide between said inlet means and said sensing chamber liquid flow through said reservoir.

13. An apparatus according to claim 11 wherein said delay means comprises a restricted portion of said flow passage means and adapted to establish between said inlet means and said sensing chamber a reduced liquid flow rate with respect to the liquid flow rate provided between said inlet means and said reservoir.

14. An apparatus according to claim 10 wherein said flow passage means is arranged to provide between said inlet means and said sensing chamber liquid flow through said reservoir.

15. An apparatus according to claim 10 wherein said delay means comprises a restricted portion of said flow passage means and adapted to establish between said inlet means and said sensing chamber a reduced liquid flow rate with respect to the liquid flow rate provided between said inlet means and said reservoir.

* * * * *